US011473255B2

(12) United States Patent
Bullock

(10) Patent No.: US 11,473,255 B2
(45) Date of Patent: Oct. 18, 2022

(54) BARRIER SYSTEM, BARRIER CONNECTION APPARATUS, BARRIER ELEMENT AND METHOD OF USE THEREOF

(71) Applicant: Highway Care Limited, Sittingbourne (GB)

(72) Inventor: Adrian Bullock, Sittingbourne (GB)

(73) Assignee: Highway Care Limited, Kent (GB)

( * ) Notice: Subject to any disclaimer, the term of this patent is extended or adjusted under 35 U.S.C. 154(b) by 135 days.

(21) Appl. No.: 16/976,951

(22) PCT Filed: Mar. 4, 2019

(86) PCT No.: PCT/GB2019/050592

§ 371 (c)(1),
(2) Date: Aug. 31, 2020

(87) PCT Pub. No.: WO2019/171032

PCT Pub. Date: Sep. 12, 2019

(65) Prior Publication Data

US 2020/0392682 A1 Dec. 17, 2020

(30) Foreign Application Priority Data

Mar. 8, 2018 (GB) ..... 1803726
Sep. 17, 2018 (GB) ..... 1815091

(51) Int. Cl.
*E01F 15/08* (2006.01)

(52) U.S. Cl.
CPC ..... *E01F 15/088* (2013.01); *E01F 15/08* (2013.01)

(58) Field of Classification Search
CPC ..... E01F 15/088; E01F 15/08
See application file for complete search history.

(56) References Cited

U.S. PATENT DOCUMENTS 4,035,972 A * 7/1977 Timmons ..... E04B 2/7425 52/36.6
4,498,803 A * 2/1985 Quittner ..... E01F 15/006 404/6

(Continued)

FOREIGN PATENT DOCUMENTS

DE 8916060 U1 * 6/1993
EP 0462307 12/1991

(Continued)

OTHER PUBLICATIONS

International Preliminary Report on Patentability for PCTIGB2019/050592 dated Sep. 8, 2020.

(Continued)

*Primary Examiner* — Raymond W Addie
(74) *Attorney, Agent, or Firm* — Woodard, Emhardt, Henry, Reeves & Wagner, LLP

(57) ABSTRACT

A barrier system is provided including first and at least second barrier elements. At least a portion of the first and second barrier elements have a hollow interior. Barrier connection apparatus is provided for releasably connecting an end of the first barrier element to an end of the at least second barrier element in use. The barrier connection apparatus has connection means provided on or associated with the same which are arranged to allow detachable attachment to each of the first and at least second barrier elements in use. The barrier connection apparatus is arranged and dimensioned so that at least a part of the barrier connection apparatus is insertable into the hollow interior portions of the first and second barrier elements in use in order to releasably connect the first and at least second barrier elements together.

17 Claims, 10 Drawing Sheets

(56) References Cited

U.S. PATENT DOCUMENTS

Figure 1A:
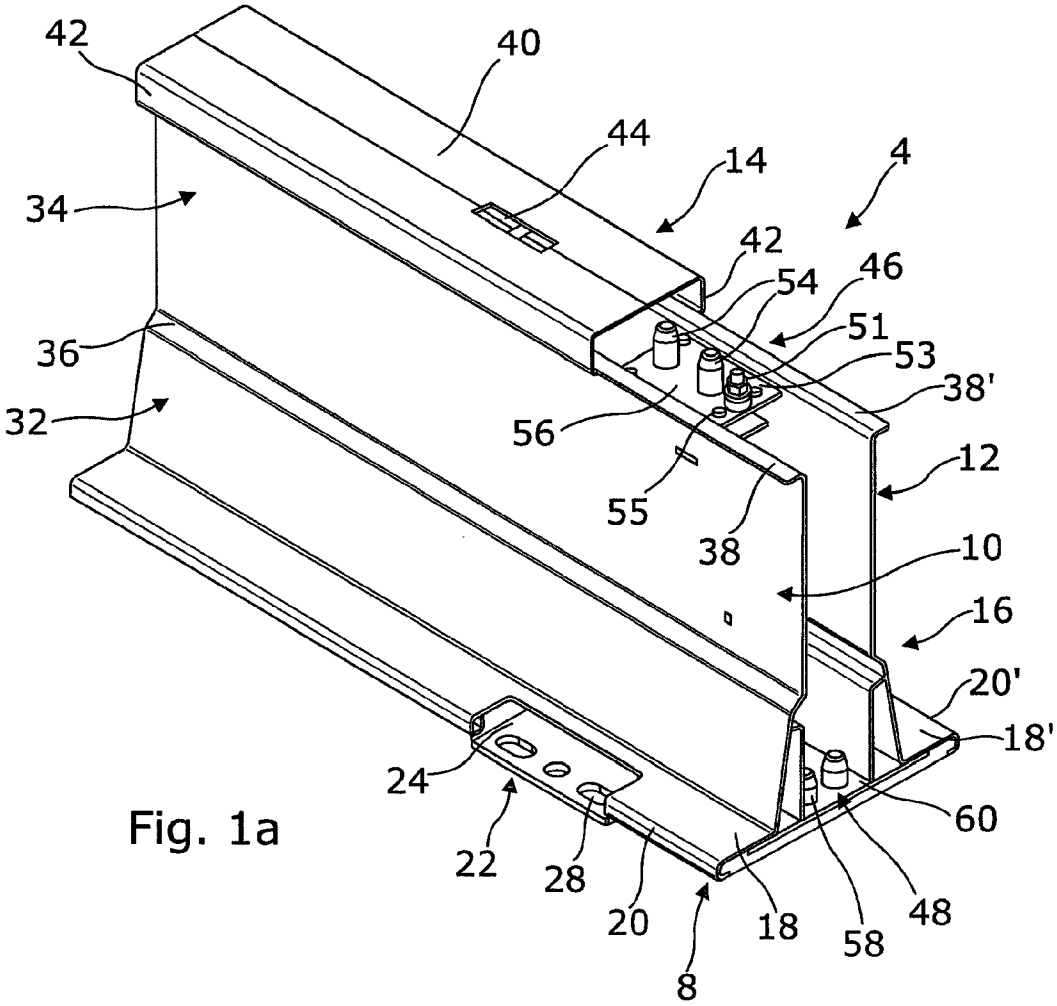
Figure 1E:
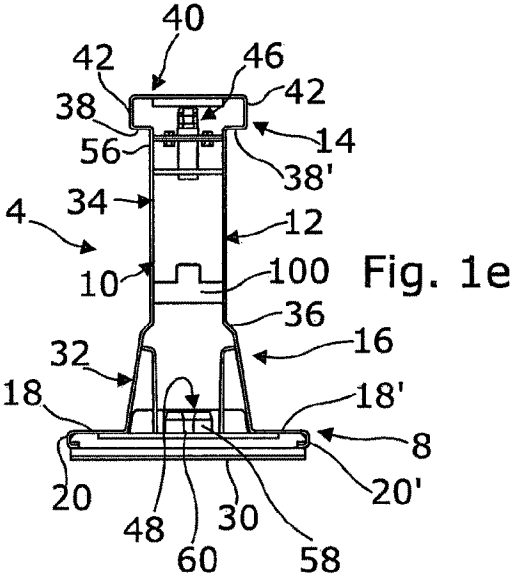
Figure 1B:
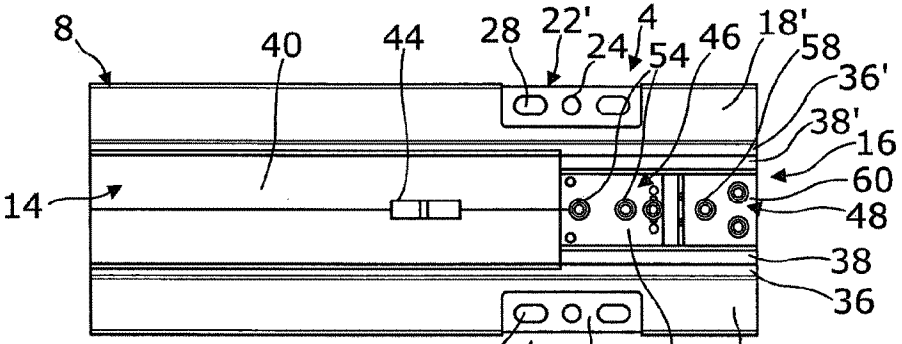
Figure 1C:
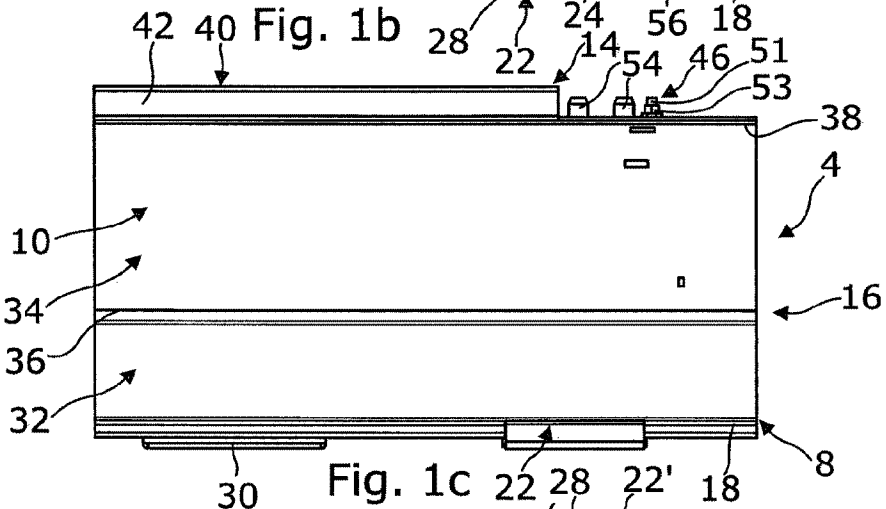
Figure 1D:
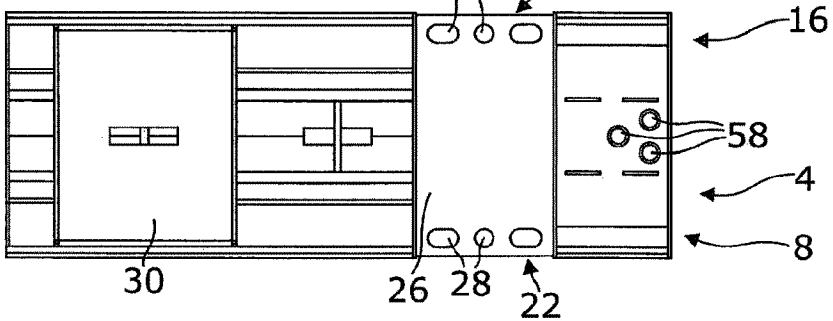
Figures 2A, 2B, 2C, 2D, 2E, 2F:
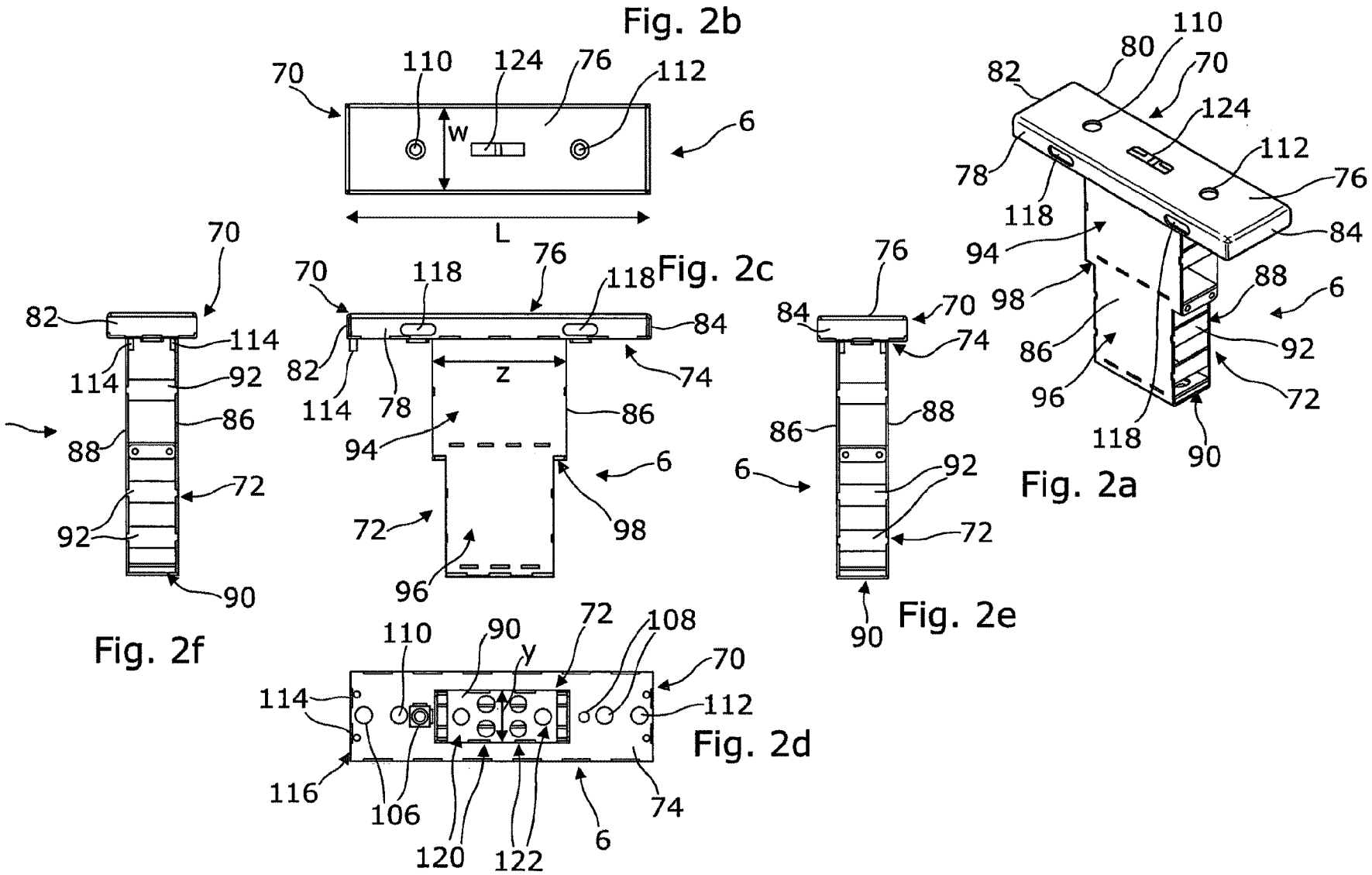
Figures 3A, 3B, 3C, 3D, 3E:
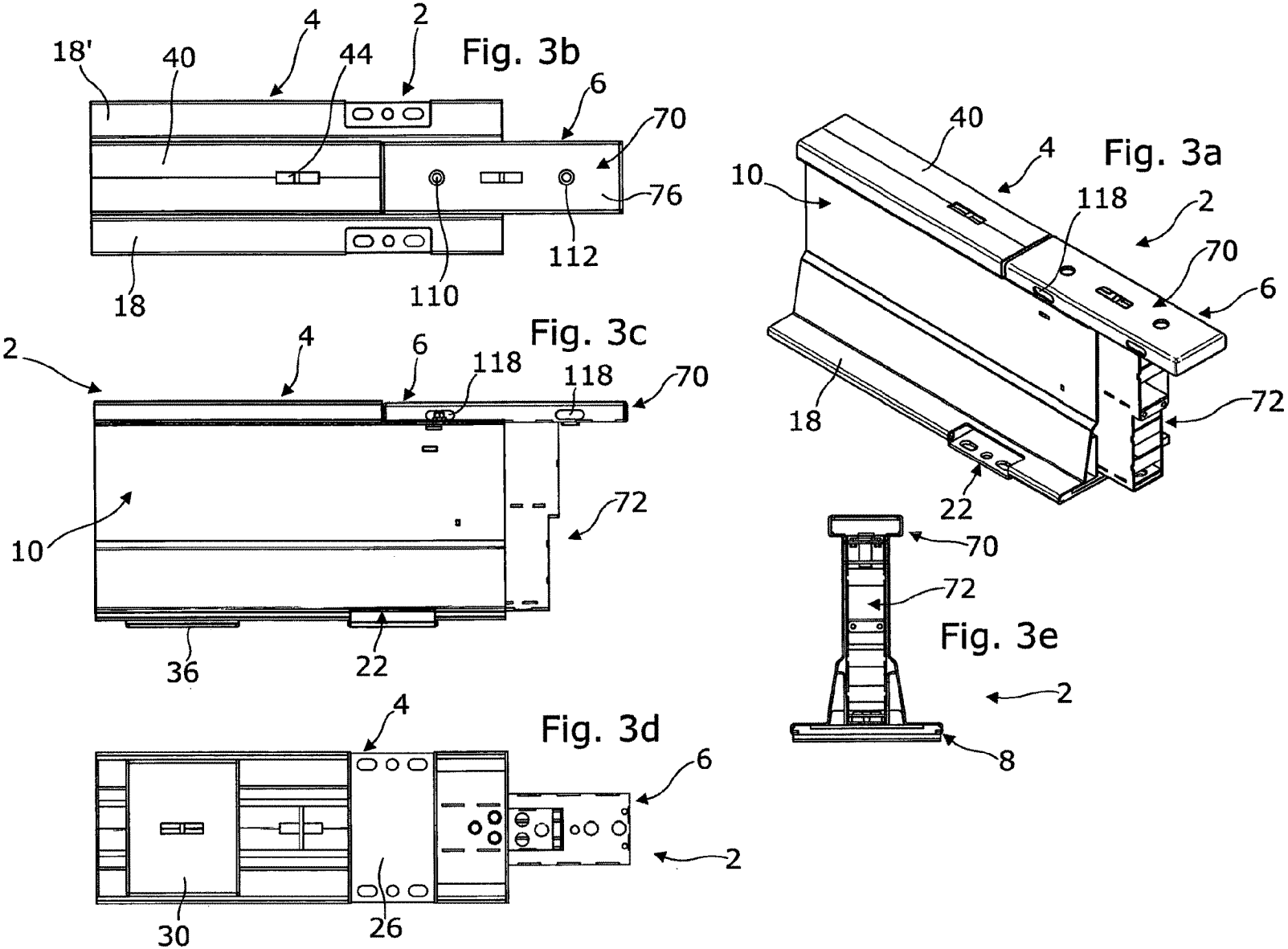
Figures 4A, 4B, 4C, 4D, 4E:
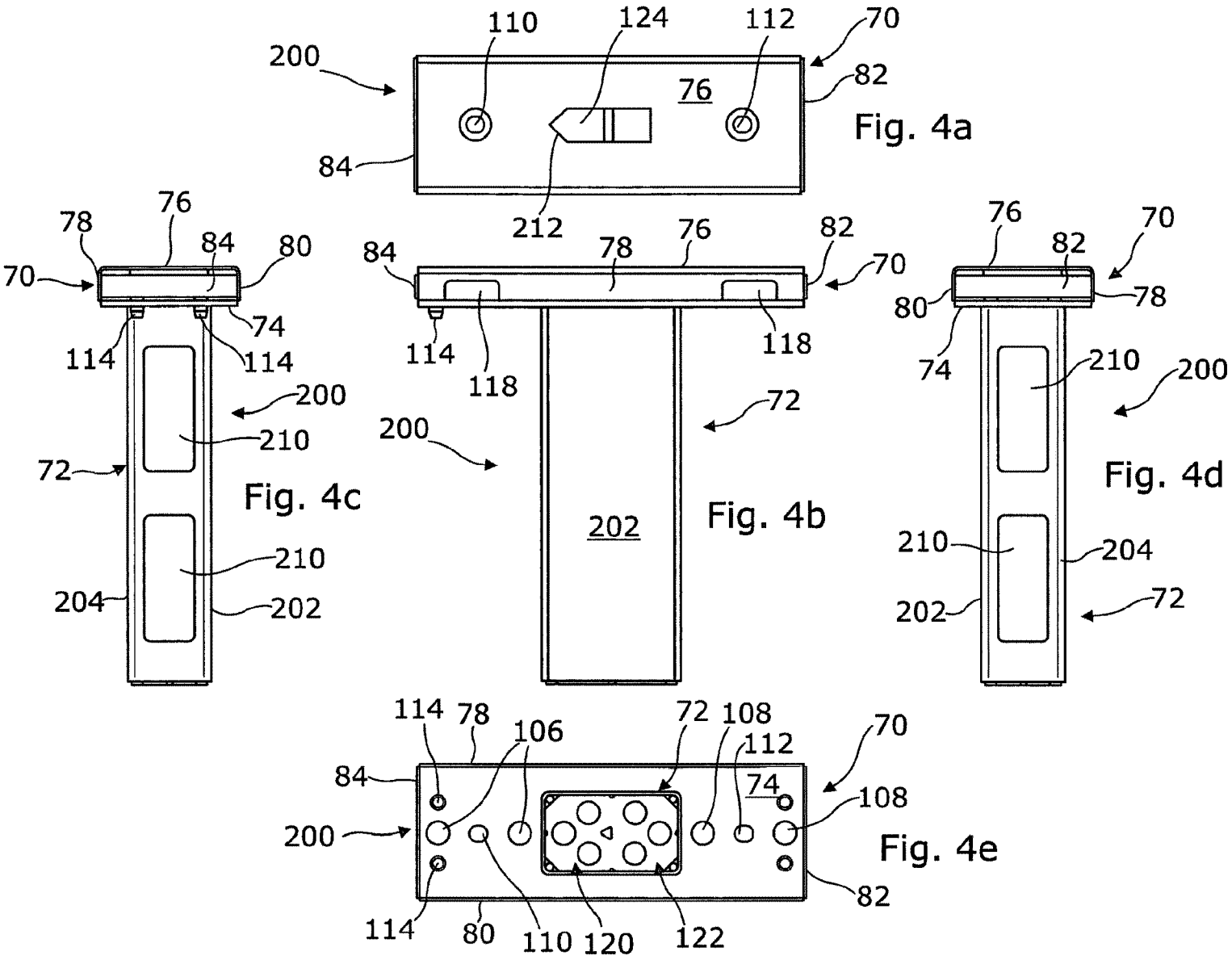

| | | | | | |
|---|---|---|---|---|---|
| 4,661,010 | A * | 4/1987 | Aimer | E01F 15/083 | 404/9 |
| 5,688,071 | A * | 11/1997 | Owen | E01F 15/088 | 404/6 |
| 6,203,242 | B1 * | 3/2001 | Englund | E01F 15/083 | 404/9 |
| 7,144,186 | B1 * | 12/2006 | Nolte | E01F 15/083 | 404/6 |
| 7,416,364 | B2 * | 8/2008 | Yodock, III | E01F 15/083 | 404/9 |
| 7,654,768 | B1 * | 2/2010 | Tullis | E01F 15/083 | 404/6 |
| 9,897,123 | B2 * | 2/2018 | Esposito | E01F 15/088 | |
| 2010/0111602 | A1 * | 5/2010 | Yodock, III | E01F 15/086 | 404/6 |

FOREIGN PATENT DOCUMENTS

| | | | | |
|---|---|---|---|---|
| EP | 1418274 | | 5/2004 | |
| EP | 1927699 | | 6/2008 | |
| EP | 2392734 | | 12/2011 | |
| EP | 2468958 | | 6/2012 | |
| FR | 2749329 | A1 * | 12/1997 | E01F 15/0476 |
| FR | 2874391 | A1 * | 2/2006 | E01F 15/083 |
| NL | 2016049 | | 7/2017 | |

OTHER PUBLICATIONS

International Search Report of PCT/GB2019/050592 dated May 13, 2019.

* cited by examiner

L
W
Z
Y 2
4
6
8
10
18
18'
22
26
30
36
40
44
70
72
76
110
112
118

70
72
74
76
78
80
82
84
106
108
110
112
114
118
120
122
124
200
202
204
210
212

BARRIER SYSTEM, BARRIER CONNECTION APPARATUS, BARRIER ELEMENT AND METHOD OF USE THEREOF

This invention relates to a barrier system, barrier connection apparatus, barrier element and/or a method of using the same.

Although the following description refers almost exclusively to a barrier system, barrier element and barrier connection apparatus to form part of a highway crash barrier, it will be appreciated by persons skilled in the art that the present invention can be used to provide any type of barrier for any purpose or application, or for use on any suitable surface, such as for example a barrier to stop one or more people, animals and/or objects from passing from one side of the barrier to an opposite side of the barrier, a pedestrian barrier, a sign carrying barrier, a fence type of barrier, an off-road barrier and/or the like.

It is known to connect a plurality of barrier elements together in an end to end manner to form an elongate barrier structure or system in use. Such barrier structures can be temporary structures, in that they can be free standing or temporarily anchored to a ground surface in use to allow placement and/or removal as often as required, or they can be permanent structures wherein they are fixedly attached to a ground surface in use.

An example of a temporary barrier element is shown in GB2403500. The barrier element has a first end comprising an upper tenon connection that protrudes outwardly from the first end, and a lower mortise connection that is recessed within the hollow interior of the barrier at said first end. The second end of the barrier element comprises an upper mortise connection that is recessed within the hollow interior of the barrier element, and a lower tenon connection that is also recessed within the hollow interior of the barrier element at the second end. The first end of a first barrier element is joined to the second end of a second barrier element in use by engaging the upper and lower mortise and tenon connections together. The barrier elements can then be joined in an end to end manner to form an elongate barrier structure.

Problems associated with this type of temporary barrier element are that in order to engage the mortise and tenon connections together, the mortise and tenon connection of the first barrier element has to be inserted into the hollow interior of the second barrier element in a horizontal sliding motion, followed by a vertical motion to bring the mortise and tenon connections of the barrier elements into engagement. This has to be performed by a crane due to the weight of the barrier elements. The precision required to allow engagement during the horizontal and vertical movements is complex and time consuming. As such, this barrier is not ideal for applications where rapid erection of a temporary barrier structure is required, such as for example during a limited closure period of a highway to undertake highway repairs.

In addition, the tenon connection that protrudes outwardly from the first end of the barrier element results in the barrier element taking up a relatively large amount of space and therefore makes the barrier elements difficult and expensive to transport. Generally, such barrier elements can only be transported on the back of an open flatbed truck due to the length of the barrier elements.

Furthermore, once an elongate barrier structure has been formed using the barrier elements, it is not possible to remove a middle barrier element from the elongate barrier structure without first removing all the barrier elements leading up to the middle barrier element. This limits the applications of use for the barrier element.

In addition, the barrier elements can only be used in one orientation in order to allow the mortise connection of one barrier element to be correctly engaged with the tenon connection of an adjacent barrier element. This adds to the complexity and difficulties of forming an elongate barrier structure with the barrier elements.

It is therefore an aim of the present invention to provide a barrier system that overcomes the abovementioned problems.

It is an aim of the present invention to provide barrier connection apparatus that overcomes the abovementioned problems.

It is a further aim of the present invention to provide a barrier element for use with a barrier system and/or barrier connection apparatus that overcomes the abovementioned problems.

It is a yet further aim of the present invention to provide a method of using a barrier system, barrier connection apparatus and/or a barrier element.

According to a first aspect of the present invention there is provided a barrier system, said barrier system including first and at least second barrier elements, at least a portion of the first and second barrier elements having a hollow interior, and barrier connection apparatus for releasably connecting an end of the first barrier element to an end of the at least second barrier element in use, said barrier connection apparatus having connection means provided on or associated with the same which are arranged to allow detachable attachment to each of the first and at least second barrier elements in use, and wherein the barrier connection apparatus is arranged and dimensioned so that at least a part of the barrier connection apparatus is insertable into the hollow interior portions of the first and second barrier elements in use in order to releasably connect the first and at least second barrier elements together.

Thus, the present invention provides a barrier system including barrier connection apparatus which allows for the connection of the ends of first and second barrier elements together using the barrier connection apparatus (i.e. the barrier connection apparatus acts as an intermediate member to allow indirect connection of the barrier elements together) rather than requiring direct engagement between the ends of the barrier elements in use. This provides a number of advantages:

Firstly, it significantly simplifies the connection process by which the first and second barrier elements are connected together in use, thereby allowing the barrier elements to be joined together quickly and easily. This is an important advantage if the barrier elements and barrier connection apparatus are to be provided as part of a temporary barrier system in use. However, it is to be noted that the barrier system of the present invention could also form a permanent barrier system if required.

The barrier connection apparatus can be fitted to the barrier elements by moving the same in a single and/or vertical direction only (i.e. in a direction transverse or perpendicular to the longitudinal axis of the barrier elements or barrier connection apparatus), simply by dropping the barrier connection apparatus into engagement with the barrier elements from a starting position above the barrier elements. Although, the barrier connection apparatus can undergo lateral or horizontal movement during the fitting/connection process if required, there is no essential requirement for both horizontal and vertical movement in connecting the barrier elements together as there is for some prior art barrier systems.

Secondly, since the barrier connection apparatus of the present invention can be detachably attached or releasably connected to two adjoining barrier elements by moving the connection apparatus in a single and/or vertical direction only, this allows a barrier element within the middle of an elongate barrier system comprised of a plurality of barrier elements joined end to end to be replaced and/or removed as and when required. This allows the apparatus, barrier elements and/or barrier system to be used for a much wider range of applications compared to some prior art barrier systems.

In addition, since the barrier connection apparatus of the present invention can be removed entirely from the barrier elements when not in use, this reduces the overall size and/or length of the barrier elements for the purposes of storage and/or transportation. Thus, the barrier elements can be provided without any barrier connection means protruding outwardly beyond the outermost perimeter or ends of the barrier elements. This allows the barrier elements to be fitted into standard 12 foot shipping containers rather than requiring transportation solely by open flatbed trucks, as is the case with some of the prior art barrier systems. This reduces the costs associated with transporting and/or storing the barrier elements in use. Furthermore, the barrier elements within the barrier system of the present invention can be made identical or substantially identical to each other and there is no requirement for specific male ended barrier elements and female ended barrier elements as there are with some prior art barrier elements. The barrier connection apparatus can also be used in two possible orientations. This means the barrier elements and/or the barrier connection apparatus of the present invention can be fitted in any end to end orientation, thereby greatly simplifying the connection process of connecting barriers together in use.

In one embodiment the barrier system can be provided as a kit of parts (i.e. barrier connection apparatus and barrier elements as separate components which are brought together for connection in use).

In one embodiment the barrier connection apparatus is arranged to provide a rigid or substantially rigid connection between the first and second barrier elements when connected in use. Thus, when the barrier connection apparatus is fitted to the barrier elements in use, there is no or substantially no pivotal movement or sliding movement between the two barrier elements. In this embodiment preferably at least part of the barrier connection apparatus is located between two or more walls or opposite walls of each barrier element to restrict or prevent rotation of the barrier connection apparatus relative to the barrier element, or the barrier elements relative to each other, when engaged in use.

In one embodiment the barrier connection apparatus is arranged to provide a pivotal connection between the first and second barrier elements when connected in use. In this embodiment preferably at least part of the barrier connection apparatus is arranged to engage with a point on a barrier element about which it can pivot in use.

Preferably the at least hollow interior portion of the barrier elements is preferably immediately adjacent an end or both ends of each barrier element.

Preferably the at least hollow interior portion of the barrier elements has an opening at a top of the barrier element and at and end of the barrier element to allow receipt of the barrier connection apparatus there in in use.

Preferably the top of the barrier element is opposite to a base of the barrier on which the barrier is to be located on a ground surface in use.

Preferably the end of the barrier element is provided between two side walls of the barrier element.

Preferably the top opening and the end opening of the hollow interior portion of the barrier elements are in fluid communication with each other.

Preferably the barrier connection apparatus comprises or consists of a body portion or a single body portion that is entirely removable from the barrier elements in normal use of the same.

Preferably removal of the barrier connection apparatus is in the opposite direction to when the barrier connection apparatus is fitted to the barrier elements (i.e. in a direction transverse or parallel to the longitudinal axis of the barrier elements).

Preferably the barrier connection apparatus is movable from a disengaged or out-of-use position wherein the barrier connection apparatus can be a spaced distance apart from the first and second barrier elements, to an engaged or in-use position, wherein the barrier connection apparatus is connected to the first and second barrier elements.

Preferably the barrier connection apparatus is arranged so that at least part of the apparatus is brought into overlapping engagement with the first and second barrier elements in use when connected with the same.

Preferably the barrier connection apparatus or the body portion of the barrier connection apparatus is T-shaped or substantially T-shaped in form. For example, the barrier connection apparatus or body portion can include a first or head member and a second or neck member protruding outwardly from the first or head member at a central position of the first or head member or between ends of the first or head member.

Preferably the second or neck member protrudes perpendicularly or transversally to the first or head member.

Preferably the connection means are provided on or associated with a lower surface, or a barrier facing surface, of the barrier connection apparatus and can be moved into engagement with the barrier elements, and further preferably into engagement with attachment means on the barrier elements, by moving the lower surface of the barrier connection apparatus towards said barrier elements in a vertical or substantially vertical direction in use.

In one embodiment the connection means of the barrier connection apparatus includes first connection means for connecting a first part of the end of the first barrier element and a first part of the end of the second barrier element in use, and second connection means for connecting a second part of the end of the first barrier element and a second part of the end of the second barrier element in use.

Preferably the first connection means connect with first attachment means provided on the ends of the barrier elements in use.

Preferably the second connection means connect with second attachment means provided on the ends of the barrier elements in use.

Preferably the first and second connection means are provided a spaced distance apart on the barrier connection apparatus, and further preferably are provided a spaced distance apart in a vertical or upright axis on the barrier connection apparatus.

Preferably the first and second attachment means are provided a spaced distance apart on the barrier element, and further preferably are provided a spaced distance apart in a vertical or upright axis on the barrier element.

Preferably the first and second connection means are provided a spaced distance apart on the barrier connection apparatus in an axis perpendicular or transverse to the longitudinal axis of the barrier elements or barrier connection apparatus.

Preferably the first and second attachment means are provided a spaced distance apart on the barrier element in an axis perpendicular or transverse to the longitudinal axis of the barrier elements.

Further preferably the first and second connection means are provided a spaced distance apart on the barrier connection apparatus in a horizontal or substantially horizontal axis.

Further preferably the first and second attachment means are provided a spaced distance apart on the barrier element in a horizontal or substantially horizontal axis.

Preferably the first and second connection means are provided a spaced distance apart on the barrier connection apparatus in a direction parallel to a longitudinal axis of the barrier connection apparatus and/or barrier element.

Preferably the first and second attachment means are provided a spaced distance apart on the barrier element in a direction parallel to a longitudinal axis of the barrier element.

Preferably the first connection means is any means or mechanism which allows the barrier connection apparatus to be detachably attached to the first part or first attachment means of the first and/or second barrier elements in use.

Preferably the second connection means is any means or mechanism which allows the barrier connection apparatus to be detachably attached to the second part or second attachment means of the first and/or second barrier elements in use.

Preferably the connection means are detachably engagable or releasably connected with attachment means provided on the barrier element(s) in use.

Preferably the first connection means of the barrier connection apparatus are engagable with first attachment means of the, or each, barrier element.

Preferably second connection means of the barrier connection apparatus are engagable with second attachment means of the, or each, barrier element.

In one embodiment the connection means is in the form of one of one or more pins, bosses, screws, bolts, protruding members and/or tenons, or one or more recesses, channels, apertures, and/or blind holes which detachably connect with the attachment means in the form of the other of one or more pins, bosses, screws, bolts, protruding members and/or tenons, or one or more recesses, channels, apertures and/or blind holes.

In one embodiment the first connection means or mechanism is one of one or more pins, bosses, screws, bolts, protruding members, tenons and/or the like, or one or more recesses, channels, apertures, blind holes and/or the like which is engageable with first attachment means in the form of the other of one or more pins, bosses, screws, bolts, protruding members, tenons and/or the like, or one or more recesses, channels, apertures, blind holes and/or the like.

In one embodiment the second connection means or mechanism is one of one or more pins, bosses, screws, bolts, protruding members, tenons and/or the like, or one or more recesses, channels, apertures, blind holes and/or the like which is engageable with second attachment means in the form of the other of one or more pins, bosses, screws, bolts, protruding members, tenons and/or the like, or one or more recesses, channels, apertures, blind holes and/or the like.

The first connection means or mechanism can be the same or substantially the same as the second connection means or mechanism. Alternatively, the first connection means or mechanism can be different or substantially different to the second connection means or mechanism.

The first attachment means or mechanism can be the same or substantially the same as the second attachment means or mechanism. Alternatively, the first attachment means or mechanism can be different or substantially different to the second attachment means or mechanism.

In a preferred embodiment the one or more pins, bosses, screws, bolts, protruding members, tenons and/or the like are provided on or associated with the first and/or second parts of the first and/or second barrier elements.

In a preferred embodiment the one or more recesses, channels, apertures, blind holes and/or the like are provided on or associated with the barrier connection apparatus.

Preferably the one or more pins, bosses, screws, bolts, protruding members, tenons and/or the like are arranged to protrude outwardly from the barrier element and/or barrier connection apparatus in a direction perpendicular, substantially perpendicular or transverse with respect to a longitudinal axis of the barrier element in use.

Preferably a central axis passing through an opening of the one or more recesses, channels, apertures, blind holes and/or the like of the barrier connection apparatus is perpendicular, substantially perpendicular or transverse to the planar opening of the recess, channel, aperture, blind hole and/or the like and perpendicular, substantially perpendicular or transverse to the longitudinal axis of the barrier element in use.

Preferably the connection means, first connection means or mechanism, second connection means or mechanism or attachment means includes two or more pins, bosses, screws, bolts, protruding members, tenons, recesses, channels, apertures, blind holes and/or the like.

In one embodiment the connection means, first connection means or mechanism, or attachment means includes a safety bolt arrangement or safety pin. The safety bolt arrangement or safety pin allows the barrier connection apparatus to be bolted or further secured onto the barrier element in use.

Preferably the safety bolt arrangement or safety pin can be provided between two or more pins, bosses, protruding members, tenons, recesses, channels, apertures, blind holes and/or the like, it can be provided laterally and/or in linear alignment with the two or more pins, bosses, protruding members, tenons, recesses, channels, apertures, blind holes and/or the like.

Preferably the two or more pins, bosses, screws, bolts, protruding members, tenons, recesses, channels, apertures, blind holes and/or the like of the first and/or second connection means or mechanism are provided a spaced distance apart from each other. Further preferably they are a spaced distance apart in a direction parallel to the longitudinal axis of the barrier connection apparatus or barrier element in use.

In one embodiment the first connection means or mechanism are provided at, adjacent, or towards a top of the barrier connection apparatus, and further preferably on at least a lower surface of a top part of the barrier connection apparatus (i.e. on the surface that will face towards the barrier element when fitted in use).

In one embodiment the second connection means or mechanism are provided at, adjacent or towards a base of the barrier connection apparatus, and further preferably on at least a lower surface of the base part of the barrier connection apparatus (i.e. on a surface that will face towards the barrier element when fitted in use).

Preferably the top of the barrier connection apparatus is to be located at, abutting or adjacent a top of the barrier element when the connection apparatus is joined to the barrier element in use.

Preferably the base of the barrier connection apparatus is to be located at, abutting or adjacent a base of the barrier element when the connection apparatus is joined to the barrier element in use.

Thus, in one embodiment the barrier connection apparatus extends entirely or substantially entirely between a top of the barrier element and a base of the barrier element.

Preferably the ends of the two barrier elements being joined together by the barrier connection apparatus are brought into abutting relationship with each other prior to the barrier connection apparatus being fitted.

Preferably the side impact walls of the two barrier elements being joined together by the barrier connection apparatus are flush or substantially flush with each other in use.

In one embodiment the barrier connection apparatus is symmetrical or substantially symmetrical in form. This allows the connection apparatus to be attached to the ends of the barrier elements in either one of two possible orientations in use. For example, the barrier connection apparatus can be symmetrical about a vertical axis. However, the barrier connection apparatus could be asymmetrical in form if required. For example, the barrier connection apparatus could be asymmetrical about a vertical and/or a horizontal axis.

Preferably the first connection means or mechanism of the barrier connection apparatus comprises two connection portions; a left first connection portion and a right first connection portion. It will be appreciated that reference to left and right could equally be referred to as first barrier element first connection portion or second barrier element first connection portion.

Preferably the left and right connection portions are provided at or adjacent opposite ends of the barrier connection apparatus.

Preferably the second connection means or mechanism of the barrier connection apparatus comprises two connection portions; a left second connection portion and a right second connection portion. It will be appreciated that reference to left and right could equally be referred to as first barrier element second connection portion or second barrier element second connection portion.

Preferably the left and right connection portions of the first connection means or mechanism are a spaced distance apart from each other.

The left and right connection portions of the first connection means or mechanism can be the same or different to each other.

Preferably the left and right connection portions of the second connection means or mechanism are a spaced distance apart from each other.

The left and right connection portions of the second connection means or mechanism can be the same or different to each other.

As previously mentioned, the barrier connection apparatus or the body portion of the barrier connection apparatus includes a second member or neck section and a first member or head section.

Preferably the first member or head section is located at an end of the second member or neck section and protrudes outwardly therefrom.

Preferably the first member or head section protrudes laterally outwardly from at least one, and preferably both sides of the second member or neck section.

Preferably the dimensions of the first member or head section are such that it protrudes outwardly from all sides of the second member or neck section.

Preferably the first connection means are provided on or associated with the first member or head section.

Preferably the left connection portion of the first connection means is provided on or associated with a part of the first member or head section that protrudes laterally outwardly from one side of the second member or neck section.

Preferably the right connection portion of the first connection means is provided on or associated with a part of the first member or head section that protrudes laterally outwardly from a further side of the second member or neck section, and further preferably from a side that is opposite to the part of the first member or head section on which the left connection portion is provided or associated thereon.

In one embodiment two or more external walls of the second member or neck section are linear, substantially linear, straight or substantially straight in form. For example, the second member or neck section could be cuboid in shape.

Preferably the second member or neck section includes front and rear walls which are arranged to be parallel or substantially parallel to at least part of the side impact walls of the barrier member in which they are located in use, and preferably an upper part of the side impact walls.

Preferably the second member or neck section includes opposing end walls located between the front and rear walls of the second member neck section. The opposing end walls can include one or more apertures or slots therein to reduce the amount of material used for forming the barrier connector apparatus in use.

In one embodiment the second member or neck section of the barrier connection apparatus includes an upper portion provided immediately adjacent to the first member or head section and a lower portion that is a spaced distance from the first member or head section.

Preferably the lower portion of the second member or neck section is shorter in length in a direction parallel to the longitudinal axis of the same compared to the upper portion.

Preferably a step or shoulder part is provided between the upper and lower portions.

Preferably the step or shoulder part is arranged to engage with one or more rib members provided in the interior of each of the barrier elements in use.

Preferably the second connection means is provided on or associated with the second member or neck section, and further preferably an end or base of the second member or neck section opposite to the end provided with the first member or head section.

Preferably the first member or head section is box like in form including a top wall, base wall, side walls and end walls.

Preferably the first member or head section includes one or more slots or apertures thereto to allow a tool and/or lifting equipment to be inserted through the same. For example, this allows a tool to be brought into contact with the first connection means and/or first attachment means of the barrier element when engaged with the same in use. For example, the tool could be used to tighten a nut associated with a bolt or boss of the connection means or attachment means in use. The lifting equipment can be used to lower and raise the barrier connection apparatus for connecting the same to the barrier elements in use.

In one embodiment the second member of the barrier connection apparatus is linear or substantially linear in form.

Preferably the second member or neck section includes at least two opposing side walls provided a spaced distance apart.

Preferably one or more rib members are provided between the two opposing side walls to provide strength and rigidity to the same.

Preferably the at least first and second barrier elements are identical or substantially identical in form.

Preferably the first and/or second barrier element has a base section, one or more side impact walls that protrude upwardly and outwardly from the base section, and a top section.

Preferably the base section is for location on or adjacent a ground surface on which the barrier element is to be provided on in use.

Preferably the top section is opposite to the base section and is arranged to be a spaced distance apart/above from the ground surface on which the barrier element is to be located in use.

Preferably the first and second barrier elements each have a first end and a second end.

Preferably the first end of each barrier element is opposite to the second end of the barrier element.

Preferably the top section does not extend all the way between the first and/or second ends of the barrier element and is set back a distance from said first and/or second ends of said barrier element. The part of the barrier element at the top of the side impact walls that does not have the top section is to allow for location of part of the barrier connection apparatus therewith in use, and preferably for location of part of the first member or head section of the barrier connection apparatus in use.

Preferably the barrier element is hollow or substantially hollow in form.

Preferably each barrier element has two side impact walls located a spaced distance apart from each other.

In one embodiment the side impact walls are arranged perpendicular or substantially perpendicular to the base section and/or the top section of the barrier element.

In one embodiment the side impact walls comprise or consist of a lower portion and an upper portion. The lower portion is adjacent to the base section and the upper portion is adjacent to the top section of the barrier element.

Preferably the side impact walls of the lower portion have a narrowing taper from the base section towards the top section.

Preferably the angle of the side impact walls of the lower portion is different to the angle of the side impact walls of the upper portion.

In one embodiment the side impact walls of the upper portion have a narrowing taper from the base section end towards the top section end.

In one embodiment the side impact walls of the upper portion protrude outwardly or below perpendicular or substantially perpendicular to the top section.

Preferably the side impact walls of the upper portion are arranged vertical or substantially vertical in use.

Preferably a stepped portion is provided between the lower portion and the upper portion of the side impact walls.

Preferably the stepped portion is sloped or provided at an angle with respect to the lower portion and the upper portion.

In one embodiment an end of the side impact walls adjacent the top section of the barrier element is provided with outwardly extending flanges.

Preferably the top section is joined to, detachably attached to or integral with the side impact walls and/or outwardly extending flanges.

In one embodiment the base section, impact side walls and top section are integrally formed.

Preferably the top section protrudes outwardly from the one or more side impact walls of the barrier element on at least one side thereof, and further preferably protrudes outwardly from both sides of the side impact walls.

Preferably a shoulder portion is defined between a lower surface of the top section that protrudes outwardly from the side impact wall and the side impact wall. Preferably this shoulder portion acts to limit travel of a vehicle in a vertical direction following impact of the same with the barrier element.

Preferably the first member or head section of the barrier connection apparatus is arranged to be flush or substantially flush with the surfaces of the top section of the barrier element when fitted to the same in use.

In one embodiment anchor means or an anchor mechanism is provided on or associated with the base section of the barrier element to allow the barrier element to be anchored to a ground surface on which the barrier element is to be used in use.

Preferably the anchor means or anchor mechanism is provided at any one or more points along the length of the base section, and further preferably at a plurality of points on the base section along an axis parallel to a longitudinal axis of the barrier element.

For example, anchor means or an anchor mechanism can be provided at an end of the barrier element, a spaced distance apart from an end of the barrier element, at a midway or central point along the length of the barrier element and/or the like.

Preferably the anchor means or the anchor mechanism include any or any combination of one or more apertures, through holes, slots, channels, anchor bolts, pins, screws and/or the like.

In one embodiment the base section protrudes outwardly from the one or more side impact walls on at least one side thereof, and further preferably on both sides of the side impact walls.

In one embodiment the anchor means or the anchor mechanism are provided on the part or parts of the base section that protrude outwardly from the side impact walls.

Preferably the anchor means or the anchor mechanism are provided on opposite or substantially opposite points of the base section that protrude outwardly from opposite sides of the side impact walls.

Preferably one or more recesses are defined in the base section and the anchor means or anchor mechanism are provided in the one or more recesses, and preferably in a base wall of the one or more recesses.

Preferably the one or more recesses in the base section are arranged to have at least one opening facing towards the top section and away from the ground surface on which the barrier element is to be located in use. Further preferably this opening is opposite or substantially opposite to the base wall of the one or more recesses.

Preferably the one or more recesses in the base section are arranged to have at least one opening facing outwardly from the side impact wall with which the base section protrudes outwardly from in use.

In one embodiment the anchor means includes an anchor element having a base anchor portion and an upright anchor portion.

Preferably the anchor element is locatable at least partially within the hollow cavity of the barrier member.

Preferably the base anchor portion sits in the one or more recesses defined in the base section and the upright anchor portion is located within the hollow cavity of the barrier member.

Preferably the anchor mechanism is defined in the base anchor portion.

Preferably the base anchor plate includes a plate or plate like member, or a tray or tray like member.

Preferably the attachment means of the barrier element are at least partially, or wholly recessed within the outermost perimeter or dimensions of the barrier element.

Preferably each barrier element is provided with first attachment means or mechanism for detachable attachment with the first connection means of the barrier connection apparatus in use.

Preferably each barrier element is provided with second attachment means or mechanism for detachable attachment with the second connection means of the barrier connection apparatus in use.

Preferably the first attachment means or mechanism are provided at or adjacent an end or first end of the barrier element.

Preferably the first attachment means or mechanism are provided a spaced distance from the end or first end of the barrier element.

Preferably the first attachment means or mechanism are provided on, adjacent to or associated with the top section of the barrier element or at an end of the side impact walls opposite to the end of the side impact walls associated with the base section of the barrier element.

Preferably the second attachment means or mechanism are provided on, adjacent to or associated with the base section of the barrier element or at an end of the side impact walls opposite to the end of the side impact walls associated with the top section of the barrier element.

Preferably the second attachment means or mechanism are provided at or adjacent an end or first end of the barrier element.

Preferably the second attachment means or mechanism are provided a spaced distance from the end or first end of the barrier element.

Preferably the second attachment means or mechanism are provided on or associated with the base section of the barrier element and within the hollow area of the barrier element.

Preferably the first and/or second attachment means or mechanism include any or any combination of one or more pins, bosses, protruding members, inter-engaging members, tenons recesses, channels, apertures, blind holes and/or the like.

Preferably the first attachment means are arranged such that with the first connection means engaged to the same in use, a top wall of the barrier connection apparatus is flush or substantially flush with a top wall of the top section of the barrier element.

Preferably the second member or neck section of the barrier connection apparatus is arranged to as to be located entirely or substantially entirely within the hollow area of the barrier elements at the ends of the barrier elements.

In one embodiment one or more feet members are provided on or associated with the base section of the barrier element to allow the barrier element to be supported on a ground surface in use.

Preferably the feet members are provided at spaced apart intervals on a lower surface of the base section of the barrier element.

Preferably the second end of the barrier element could be provided with a bolted joint, could be the same as the first end of the barrier element and/or could be provided with some other connection means.

Preferably a plurality of barrier elements are provided in an end to end arrangement to create an elongate barrier structure or system. A plurality of barrier connection apparatus can be provided, each barrier connection apparatus provided between two adjacent barrier elements.

According to one aspect of the present invention there is provided barrier connection apparatus for use in a barrier system.

According to a further aspect of the present invention there is provided a barrier element for use in a barrier system.

According to one aspect of the present invention there is provided a method of using a barrier system, said barrier system including first and at least second barrier elements, at least a portion of the first and second barrier elements having a hollow interior, said method including the steps of bringing an end of the first barrier element and an end of the second barrier element together, releasably connecting the ends of the first and second barrier elements using barrier connection apparatus, said barrier connection apparatus having connection means provided on or associated with the same to releasably connect the ends of the first and at least second barrier elements together, and wherein the barrier connection apparatus is arranged and dimensioned so that at least a part of the barrier connection apparatus is insertable into the hollow interior portions of the first and second barrier elements in order to releasably connect the first and at least second barrier elements together.

According to further aspects of the present invention there is provided a method of using barrier connection apparatus, a barrier system and/or a barrier element.

Figure 5A:
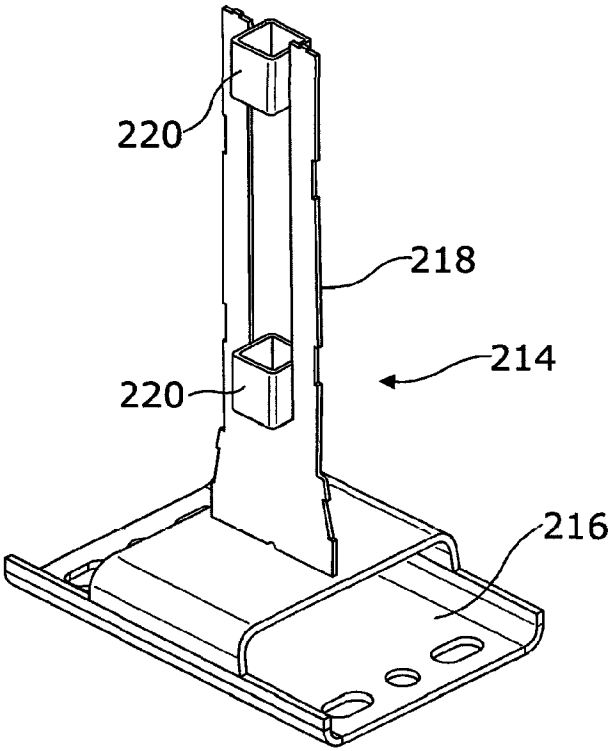
Figure 5B:
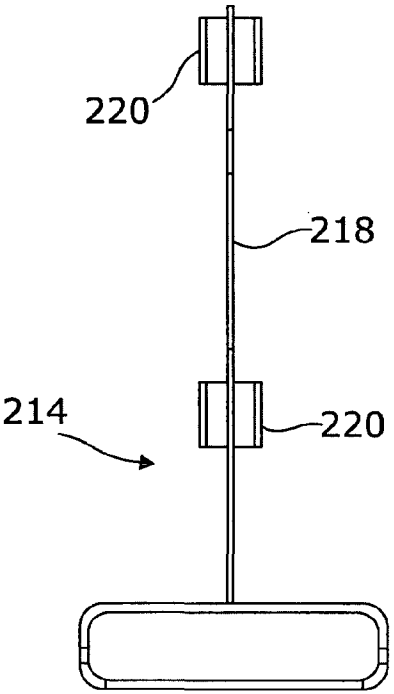
Figure 5C:
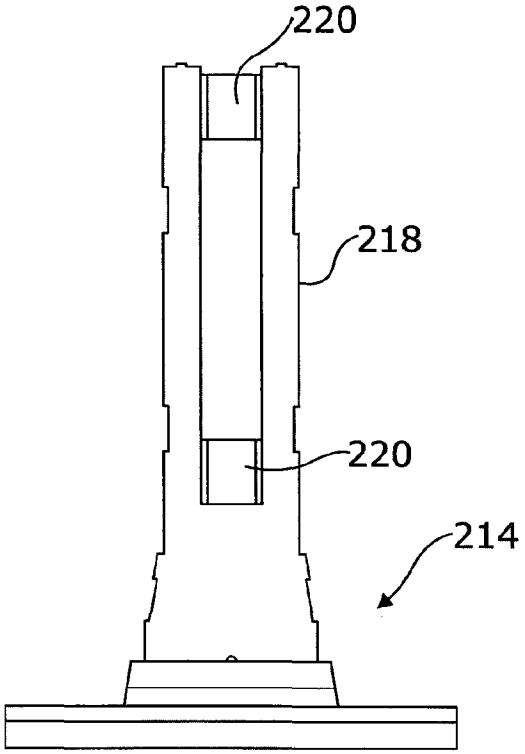
Figure 6A:
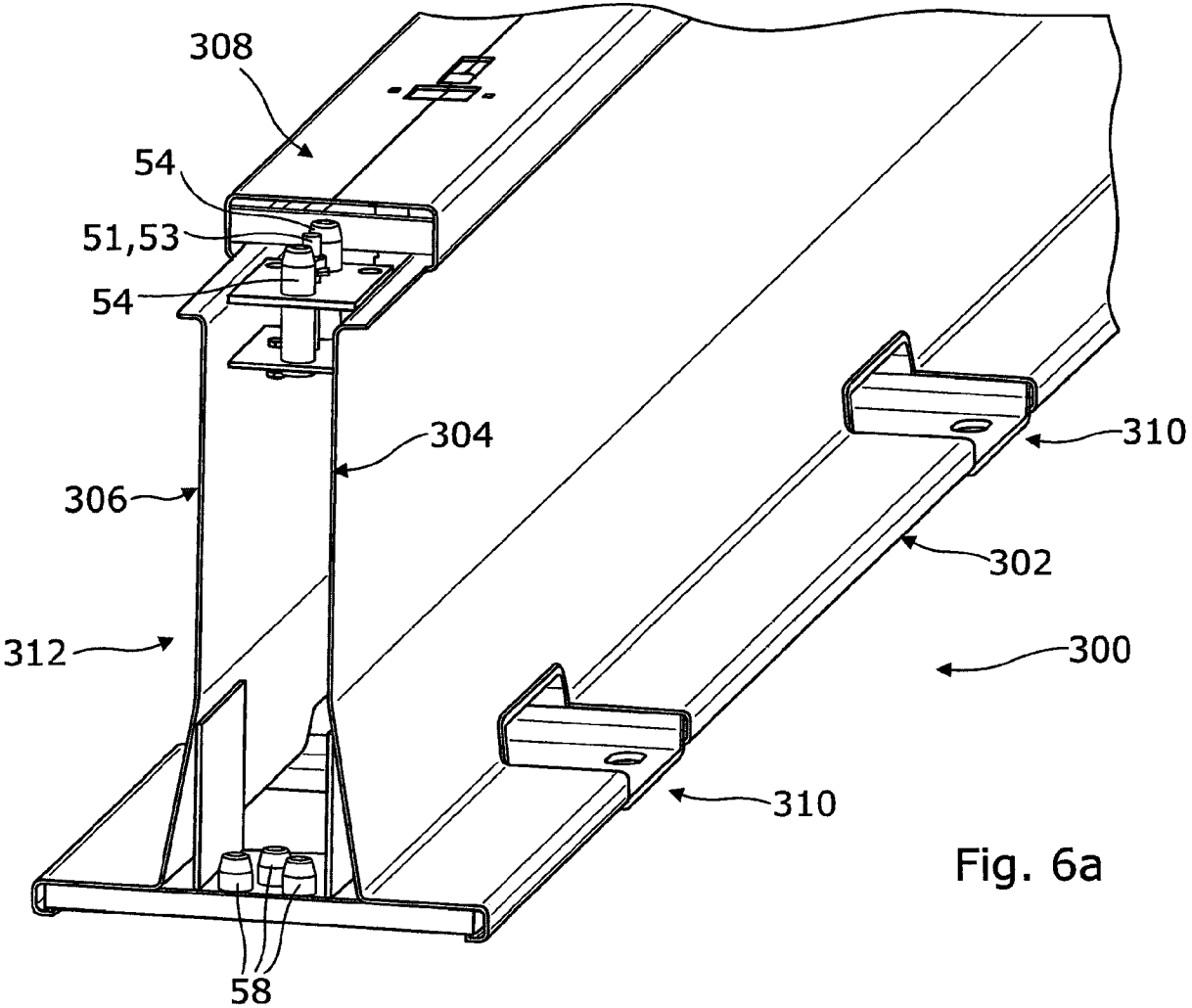
Figure 6B:
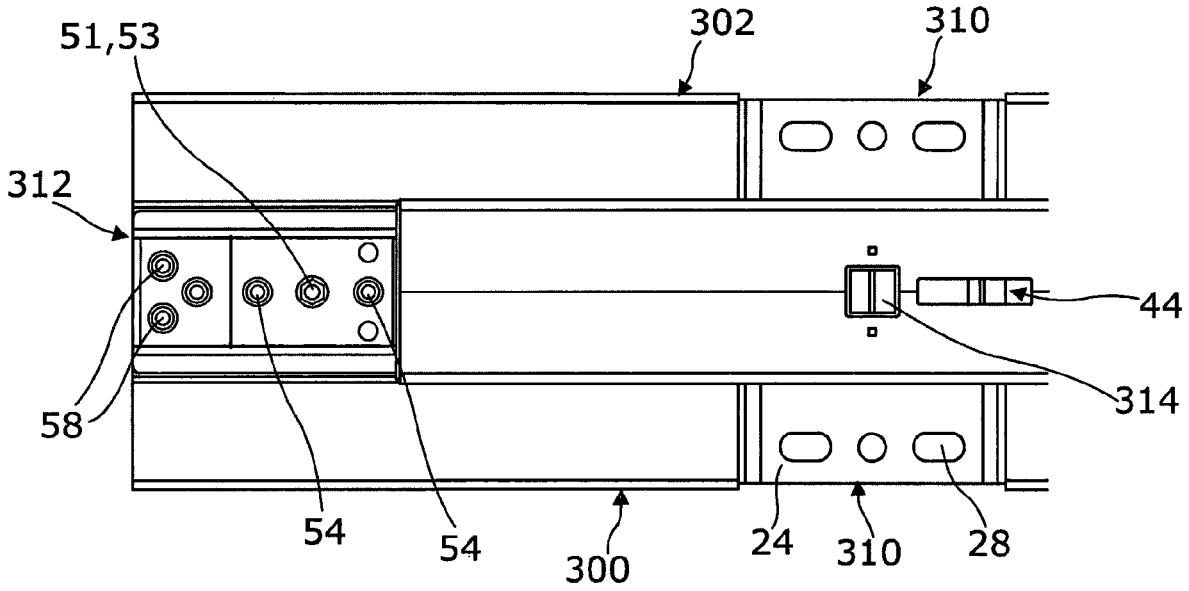
Figure 7B:
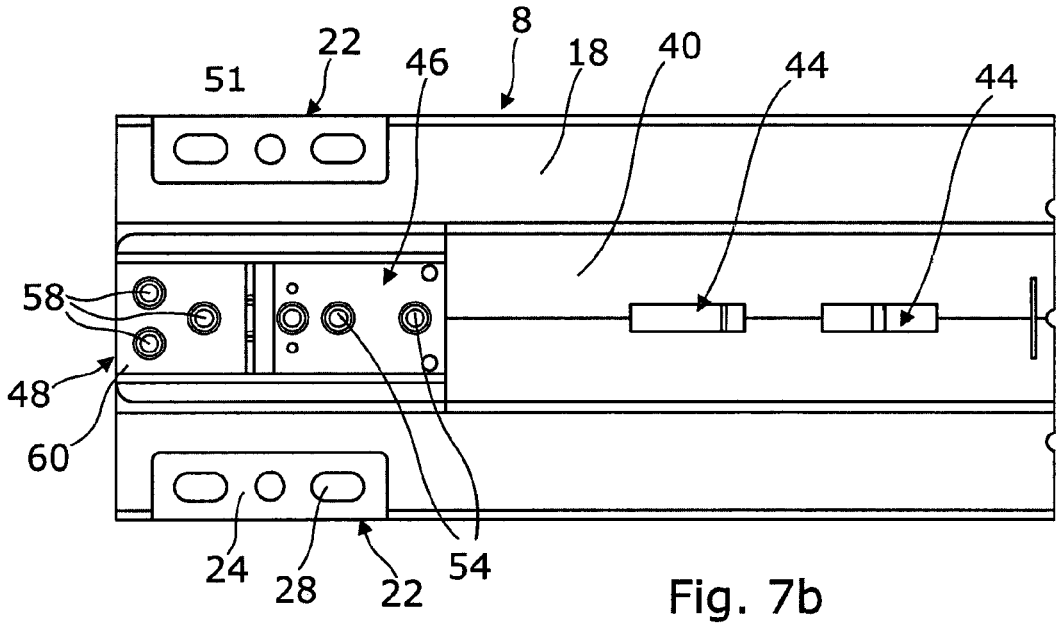
Figure 7A:
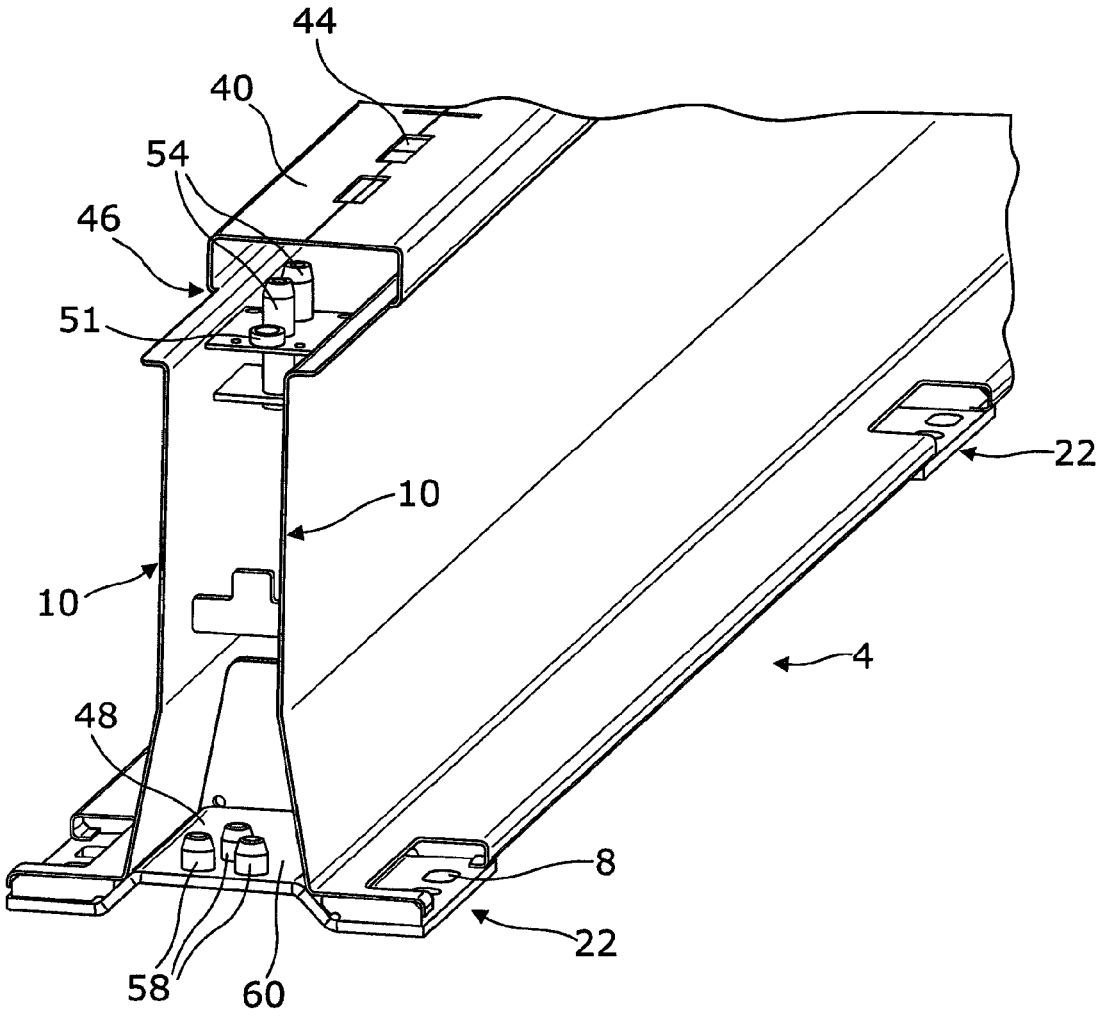
Figure 8A:
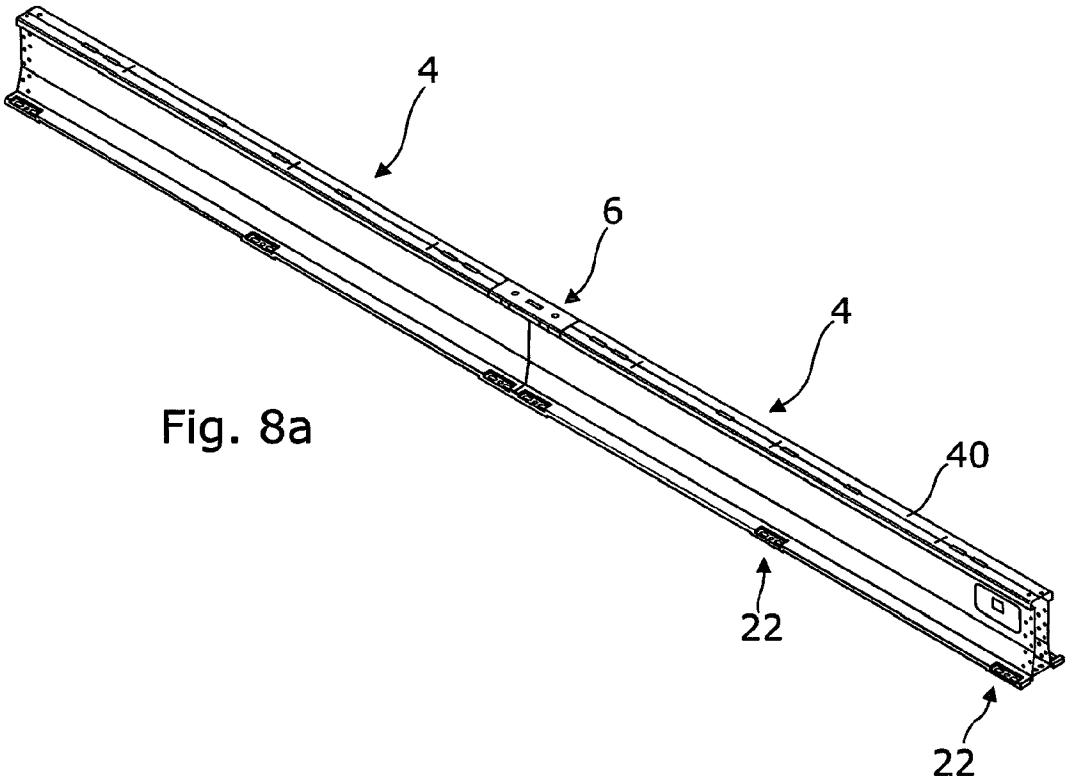
Figure 8B:
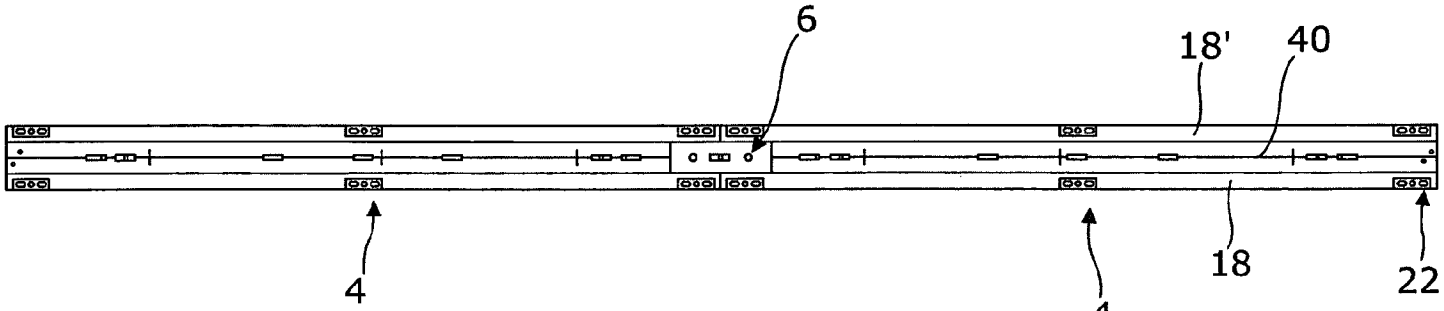

Embodiments of the present invention will now be described with reference to the following figures, wherein:

FIGS. 1*a*-1*e* show a perspective view, a top plan view, a side view, a base plan view, and an end view of a barrier element according to an embodiment of the present invention respectively;

FIGS. 2*a*-2*f* show a perspective view, a top plan view, a side view, a base plan view, a first end view and a second end view of barrier connection apparatus according to an embodiment of the present invention respectively;

FIGS. 3*a*-3*e* show a perspective view, a top plan view, a side view, a base plan view, and an end view of the barrier connection apparatus in FIGS. 2*a*-2*f* joined to the barrier element in FIGS. 1*a*-1*e* respectively;

FIGS. 4*a*-4*e* show a top plan view, a side view, a first end view, a second end view, and a base plan view of barrier connection apparatus according to a further embodiment of the present invention respectively;

FIGS. 5*a*-5*c* show a perspective view, an end view and a side view of an anchor element according to an embodiment of the present invention;

FIG. 6*a*-6*b* show a perspective view and a top plan view of part of a barrier according to one embodiment of the present invention respectively;

FIG. 7*a*-7*b* show a perspective view and a top plan view of part of a barrier according to a further embodiment of the present invention respectively;

FIGS. 8*a* and 8*b* show a perspective view and a top plan view of two barrier members joined together via barrier connection apparatus according to an embodiment of the present invention respectively. It can be seen that the top surface of the barrier connection apparatus is flush with the top surface of the barrier members to which it is joined to, thereby creating the appearance of a single continuous barrier structure.

Referring to FIGS. 1*a*-3*e*, there is illustrated a barrier system 2 comprising at least first and second barrier elements 4 (only part of one barrier element is shown for clarity purposes) which are connected together indirectly in an end to end manner by barrier connection apparatus 6.

Each barrier element 4 of the system is typically identical in form and so can be used in any end to end orientation, thereby making the process of fitting the barrier elements together significantly easier compared to conventional barrier systems. However, different barrier elements could be used in the system if required.

Each barrier element 4 has a base section 8, two side impact walls 10, 12 protruding upwardly from the base section, and a top section 14 located at an end of the side impact walls opposite to the base section 8. The barrier element has a first end 16 and a second end (not shown). The second end can be identical in form to the first end or can comprise any conventional type of barrier connection means, such as for example a bolted joint.

In the illustrated example, the base section 8 and top section 14 are integrally formed with the two side impact walls, although it will be appreciated that the base section and/or top section can be joined to the side impact walls, such as for example via welding, bolts and/or using some other suitable joining means.

The base section 8 typically includes base plate members 18, 18' that protrude laterally outwardly from each side impact wall 10, 12 respectively. Each base plate member 18, 18' is typically elongate in form and is arranged parallel to a longitudinal axis of the barrier element 4. Each base plate member 18, 18' is typically planar in form. A flanged or U-shaped end 20, 20' can optionally be provided on the outermost longitudinal edges of base plate members 18, 18' so as to prevent shaped edges being exposed on the barrier element.

Recesses 22, 22' are defined at opposite locations in the base plate members 18, 18' a spaced distance from the first end 16 of the barrier element 4. The recesses 22, 22' are for the location of anchor means for anchoring the barrier element to a ground surface in use. It is to be noted that the recesses for the anchor means could be located at any one or more positions along the length of the base section 8 to provide anchoring of the barrier element to a ground surface in use. For example, the anchor means could be provided immediately at the first end of the barrier element, at a midway or central position along the length of the base section and/or the like.

More particularly, each recess 22, 22' has a base wall 24 formed by a base plate 26 that is located perpendicular to the longitudinal axis of the barrier element 4 and protrudes outwardly from both side impact walls 10, 12 of the barrier element. The anchor means in this example include slots 28 defined in the base wall 24 of each recess 22, 22' for the location of anchor pins (not shown) therethrough in use. Each recess 22, 22' has a first opening defined in a wall of the base plate member 18, 18' that faces away from the ground surface on which the barrier element is located in use, and a second opening defined in the flanged edges 20, 20' of the base plate member 18, 18 that faces away from the side impact walls of the barrier element.

Feet members 30 can also be provided on a lower surface of the base section 8 for supporting the barrier element 4 on a ground surface in use. The feet member 30 are typically provided at spaced apart intervals along the length of the barrier element to raise the base section 8 a distance above the ground surface. The feet member are arranged transverse to the longitudinal axis of the barrier element in the illustration but could be provided in any required arrangement.

The side impact walls 10, 12 each have a lower section 32 and an upper section 34. The lower section 32 is adjacent the base section 8 and protrudes upwardly and outwardly from the base section 8. The lower section 32 has a narrowing taper towards top section 14.

The upper section 34 protrudes downwardly and below the top section 14. The upper section 34 is arranged vertically and is perpendicular to the top section 14.

The side impact walls 10, 12 are a spaced distance apart from each other and define a hollow barrier interior therebetween. The upper sections 34 of the side impact walls 10, 12 in the illustration are parallel to each other.

The length of the side impact walls are arranged parallel to the longitudinal axis of the barrier element.

A stepped section 36 is defined between the lower section 32 and upper section 34.

The top section 14 of the barrier element has a top surface 40 arranged parallel to the base section of the barrier, and side walls 42 that are arranged parallel to the upper section 34 of the side impact walls. The top section 14 is arranged parallel to the longitudinal axis of the barrier element.

The top section 14 is not provided along the entire top of the barrier element and stops a distance from the first end 16 to allow access to first attachment means 46 recessed within the barrier element at the top end of the side impact walls.

Outwardly extended flanges 38, 38' are provided at the top ends of the side impact walls 10, 12 adjacent the first end 16 where the top section 14 is not present. The flanges 38, 38' are to allow engagement with the lower surface of the barrier connection apparatus in use.

Apertures 44 are arranged at spaced apart intervals along the length of the top surface 40 to allow a crane hook or lifting attachment to be attached to the same in use.

The barrier element includes first and second attachment means 46, 48 to allow detachable attachment to first and second connection means provided on the barrier connection apparatus 6 in use.

More particularly the first attachment means 46 include two upwardly protruding pin members 54 provided a spaced distance apart on attachment plate 56. The attachment plate 56 is joined between the two side impact walls 10, 12 at the top end of the side impact walls adjacent first end 16. The pin members 54 protrude upwardly above the end of the side impact walls but below the height of the top surface of the top section 14.

A longitudinal axis of the pin members 54 is arranged perpendicular to the longitudinal axis of the barrier element 4. The spacing of the pin members 54 in this example is arranged along an axis parallel to the longitudinal axis of the barrier element, although any number and/or arrangement of the pin members could be provided so long as they allow attachment with the barrier connection apparatus in use.

In addition, the first attachment means can include a safety locking bolt or lockable engagement means in the form of an upwardly protruding boss 51 with a locking bolt 53 associated with the same, and two apertures 55 defined in attachment plate 56, as will be described in more detail below.

The second attachment means 48 include three upwardly protruding pin members 58 provided a spaced distance apart on an attachment plate 60. The attachment plate 60 is joined between the two side impact walls 10, 12 at the end of the side impact walls adjacent the base section 8. The attachment plate 60 and protruding pin members 58 are located within the interior of the barrier element 4 at the first end 16 thereof.

It is noted that the second attachment means 48 are located closer to the first end 16 of the barrier element compared to the first attachment means 46. The first attachment means 46 are relatively set back from the first end 16. Thus, the first attachment means 46 are partially or wholly offset from the second attachment means 48, thereby allowing easy placement of the barrier connection apparatus 6 with the same in use simply by dropping the barrier connection apparatus onto the barrier elements in a vertical direction. The same simple vertical action can be undertaken in reverse to allow detachment of the barrier connection apparatus with the barrier elements in use.

The barrier connection apparatus 6 includes a first member or head section 70 and a second member or neck section 72 that protrudes outwardly from a lower surface 74 of the head section 70. In this example, the neck section is arranged centrally of the head section but it could be provided at any position between the ends of the head section.

The head section 70 is in the form of a box like member having a top surface 76, a lower surface 74 opposite to the top surface, opposing side walls 78, 80 and opposing end walls 82, 84. The interior of the head section 70 is hollow.

The neck section 72 has two spaced apart and opposing side walls 86, 88 and a base wall 90 provided at an end of the neck section opposite to the head section end. The neck section 72 is hollow and a plurality of rib members 92 are provided between the opposing side walls 86, 88 to strengthen and provide rigidity to the side walls.

The neck section 72 has an upper portion 94 adjacent the head section 70 that is longer in length than a lower portion 96 of the neck section 72 adjacent base wall 90. This creates a shoulder portion 98 between the upper and lower portions 94, 96 on each side of the neck section that can be used for location with a rib member 100 defined in the interior of the barrier element 4 when connected with the barrier element in use. The rib member 100 is typically provided between the side impact walls 10, 12 midway of the barrier element between the head section 14 and base section 8.

The width 'w' of the head section of the barrier connection apparatus is larger than the width 'Y' of the neck section, such that the head section 70 protrudes outwardly from the side walls 86, 88 of the neck section 72. The length 'l' of the head section of the barrier connection apparatus is also longer than the longest length 'z' of the neck section. As such, the head section protrudes outwardly from the neck section around all sides of the neck section.

The width 'w' of the head section 70 is typically the same as the width of the top surface 40 of the barrier element 4, thereby allowing the top surfaces of the barrier element and the barrier connection apparatus to be flush or substantially flush with each other when joined together in use.

The width 'Y' of the neck section 72 is typically less than the width between the opposing side impact walls 10, 12 of the barrier element 4, thereby allowing the neck section to sit within the side walls of the barrier elements when the barrier connection apparatus is fitted to the barrier elements in use.

The barrier connection apparatus 6 includes first connection means provided on the head section 70 and second connection means provided in the base wall 90 of the neck section 72. The first connection means are for engagement with the first attachment means 46 of first and second barrier elements in use. The second connection means are for engagement with the second attachment means 48 of the first and second barrier elements in use.

The first connection means include left first connection means in the form of two apertures 106 defined in lower surface 74 for engagement with the two pins 54 on a first barrier element in use, and right connection means in the form of two apertures 108 defined in lower surface 74 for engagement with two pins 54 on a second barrier element in use.

The first connection means also includes a left through aperture 110 and a right through aperture 112 which pass between the lower surface 74 and the top surface 76 for engagement with the protruding boss 51 and locking nut 53 of at least the first barrier element. Engagement between the boss 51 and locking nut 53 takes up any tolerances between the barrier element and the barrier connection apparatus to ensure secure engagement between the same in use. It has been found that only one side of the first connection means needs to be engaged with a barrier element via the boss and locking nut and not both sides in order to obtain secure engagement.

However, both sides could be engaged via the boss and locking nut if required.

Two spaced apart pin members 114 are provided on at least one end 116 of the head section 70 for location in the apertures 55 provided on the barrier element. The pin members 114 are typically to help with location on the boss 51 and aperture 110 in use.

Side slots 118 are defined in the side walls 78, 80 of the head section 70 to allow a tool to be inserted therein to tighten up the nut 53 on the boss 51 when engaged with through aperture 110 in use.

The second connection means include left connection means in the form of a set of three apertures 120 and right connection means in the form of a set of three apertures 122, all defined in base wall 90 of the neck section 72. The apertures 120 are for engagement with the pins 58 provided on base plate 60 of a first barrier element in use. The apertures 122 are for engagement with pins 58 provided on base plate 60 of a second barrier element in use.

Thus, it can be seen that the barrier connection apparatus 6 is T-shaped in form.

In order for the ends of two barrier elements to be joined together in use, the two barrier elements are brought together in an end to end manner such that the opposing ends of the adjoining barrier elements abut each other. The barrier connection apparatus 6 is then simply dropped in place in a vertical direction from above the barrier elements, such that the first connection means engage with the first attachment means and the second connection means engage with the second attachment means. A longitudinal axis of the head section of the barrier connection apparatus is arranged to be parallel with the longitudinal axis of the barrier elements. The barrier elements can be anchored to the ground surface using the anchoring means before or after the barrier connection apparatus is engaged with the barrier elements. Further barrier elements can be joined together in a similar manner to create an elongate barrier structure.

Gripping apertures 44, 124 can be defined in the top surface 40 of the barrier element 4 and the top surface 76 of the barrier connection apparatus 6 respectively, to allow the same to be gripped and/or lifted by a crane in use.

Referring to FIGS. 4*a*-4*e*, there is illustrated a further embodiment of barrier connector apparatus 200 according to an embodiment of the present invention. Many of the features of apparatus 200 are the same as the connector apparatus 6 shown in FIGS. 2*a*-2*e* and the same reference numerals have been used to refer to the same features.

As with the previous embodiment, barrier connector apparatus 200 includes a head section 70, and a neck section 72 that protrudes outwardly from a lower surface of the head section 70.

Rather than being stepped, the external walls (opposing front and rear walls 202, 204, and opposing end walls 206, 208) of the neck section 72 are linear in form, and the neck section is cuboid in shape. The external walls are not required to engage within any rib members provided in the internal cavity of the barrier member as was required with the embodiment shown in FIGS. 2*a*-2*e*. The end walls 206, 208 have apertures 210 defined thereinto reduce the amount of material required to form the apparatus 200, and therefore reduce the weight of the same.

Gripping aperture 124 has an arrow 212 provided at one end thereof pointing in the direction of the pin members 114 to allow a user to easily visualise which end the pin members 114 are located.

Referring to FIGS. 5*a*-5*c*, there is illustrated an anchor element 214 which is welded into the interior of the barrier member during manufacture. The anchor element 214 includes an anchor base plate 216 which sits in the recess 22 at the base of the barrier member. An upright anchor portion 218 is located in the interior cavity of the barrier member. The upright anchor portion 218 is provided with sleeve portions 220 defined thereon. These sleeve portions 220 can act as support members for any accessories, posts, signage, screens and/or the like that may need to be fitted with the barrier members in use. An engaging portion of the accessory, post, signage, screens and/or the like can be moved into engagement with the support members via the top of the barrier member. The upright anchor portion 18 can be welded to one or more internally facing side impact walls of the barrier element.

Referring to FIGS. 6*a*-6*b*, there is illustrated a barrier element 300 having a base section 302, two side impact walls 304, 306, and a top section 308 located at the ends of walls 304, 306 opposite to base section 302. Anchor arrangements 310 are provided in the base section 302 to allow anchoring of the barrier element to a road surface in use. The first anchor arrangement 310 of the barrier element nearest to end 312 is set a spaced distance back from the end 312. This arrangement is in contrast to the barrier arrangement shown in FIGS. 7*a* and 7*b* wherein the first anchor arrangement is immediately adjacent the end 312. The location of the anchor arrangement provides different deflection characteristics of the barrier on impact with a vehicle in use.

An aperture 314 is defined in top section 308 to allow for the location of a post for signage, screening, accessories and/or the like.

In this embodiment, the two upwardly protruding pin members 54 are provided a spaced distance apart with the upwardly protruding boss 51 and locking bolt 53 provided between the two protruding pin members. This arrangement provides a different shear load compared to the arrangement of the locking bolt 53 in FIGS. 7*a* and 7*b*.

It will be appreciated that any or any combination of features disclosed herein can be provided on the barrier connection apparatus and/or barrier elements of the present invention.

The invention claimed is:

1. A barrier system, said barrier system comprising:

first and at least second barrier elements, at least a portion of the first and second barrier elements having a hollow interior, and barrier connection apparatus for releasably connecting an end of the first barrier element to an end of the at least second barrier element in use, said barrier connection apparatus having connection means provided on or associated with the same which are arranged to allow detachable attachment in use with attachment means provided on each of the first and at least second barrier elements, the hollow interior portion of each barrier element being provided immediately adjacent an end of the barrier element and has an opening at a top and end of each barrier member to allow receipt of the barrier connection apparatus in use, and wherein the barrier connection apparatus comprises a body portion that is T-shaped or substantially T-shaped in form and is arranged and dimensioned so that at least a part of the barrier connection apparatus is insertable into the hollow interior portions of the first and second barrier elements in use in order to releasably connect the first and at least second barrier elements together, and at least part of the barrier connection apparatus is brought into overlapping engagement with the first and second barrier elements in use when connected with the same;

the barrier elements and the barrier connection apparatus arranged such that removal and/or insertion of the barrier connection apparatus with the barrier elements is in a direction transverse or perpendicular to a longitudinal axis of the barrier elements.

2. The barrier system of claim 1 wherein the T-shaped or substantially T-shaped form of the barrier connection apparatus comprises a single body portion including a head member and a neck member protruding from the head member at a central portion of the head member.

3. The barrier system of claim 1 wherein the barrier connection apparatus consists of a neck portion and a head portion.

4. The barrier system according to claim 1 wherein the connection means is in the form of one or more pins, bosses, screws, bolts, protruding members and/or tenons, or one or more recesses, channels, apertures, and/or blind holes which detachably connect with the attachment means in the form of the other of one or more pins, bosses, screws, bolts, protruding members and/or tenons, or one or more recesses, channels, apertures and/or blind holes.

5. The barrier system according to claim 1 wherein the barrier connection apparatus extends entirely between a top of the barrier elements and a base of the barrier elements when connected to the barrier elements in use.

6. The barrier system according to claim 1 wherein the first and at least second barrier elements are identical or substantially identical in form.

7. The barrier system according to claim 1 wherein anchor means are provided on or associated with a base of the barrier elements to allow the barrier elements to be anchored to a ground surface in use.

8. A barrier connection apparatus for use with the barrier system according to claim 1.

9. The barrier system according to claim 1 wherein the barrier connection apparatus comprises a first member with a second member protruding transverse or perpendicularly outwardly from the first member at a central location of the first member or at a location between the ends of the first member.

10. The barrier system according to claim 9 wherein the second member includes an upper portion provided immediately adjacent the first member and a lower portion provided a distance apart from the first member, the lower portion being shorter in length than the upper portion so as to create a shoulder portion between the upper and lower portions, said shoulder portion arranged to engage with one or more rib members provided in the interior of each of the barrier elements in use; or the second member is linear or substantially linear in form.

11. The barrier system according to claim 9 wherein one or more slots or apertures are defined in the first member to allow insertion of a tool and/or lifting equipment therein in use.

12. The barrier system according to claim 9 wherein the first member of the barrier connection apparatus is arranged to be flush or substantially flush with a top of the barrier elements when the barrier connection apparatus is joined to the barrier elements in use;

and/or the second member of the barrier connection apparatus is arranged to be located entirely within the hollow portions of the barrier elements when connected to the barrier elements in use.

13. The barrier system according to claim 1 wherein the connection means of the barrier connection apparatus includes first connection means for connecting a first part of the end of the first barrier element and a first part of the end of the second barrier element, and second connection means for connecting a second part of the end of the first barrier element and a second part of the end of the second barrier element, the first and second connection means being provided a spaced distance apart in an axis perpendicular or transverse to a longitudinal axis of the barrier elements.

14. The barrier system according to claim 13 wherein the first and second connection means are provided a spaced distance apart in a direction parallel to the longitudinal axis of the barrier elements.

15. The barrier system according to claim 13 wherein the first connection means includes a left first connection means for connecting the barrier connection apparatus to the first barrier element and a right first connection means for connecting the barrier connection apparatus to the second barrier element, the second connection means includes a left second connection means for connecting the barrier connection apparatus to the first barrier element and a right second connection means for connecting the barrier connection apparatus to the second barrier element.

16. The barrier system according to claim 13 wherein the first and second connection means are provided a spaced distance apart on the barrier connection apparatus in an axis perpendicular or transverse to a longitudinal axis of the barrier elements.

17. A method of using a barrier system, said barrier system including first and at least second barrier elements, at least a portion of the first and second barrier elements having a hollow interior, said method comprising:

bringing an end of the first barrier element and an end of the second barrier element together, and releasably connecting the ends of the first and second barrier elements using a barrier connection apparatus having connection means provided on or associated with the same with attachment means provided on each of the first and at least second barrier elements, the hollow interior portion of each barrier element being provided immediately adjacent an end of the barrier element and having an opening at a top and end of each barrier element for receiving the barrier connection apparatus, and wherein the barrier connection apparatus comprises a body portion that is T-shaped or substantially T-shaped in form and is arranged and dimensioned so that at least a part of the barrier connection apparatus inserts into the hollow interior portions of the first and second barrier elements in order to releasably connect the first and at least second barrier elements together, and bringing at least part of the barrier connection apparatus in overlapping engagement with the first and second barrier elements when connected, the barrier elements and the barrier connection apparatus arranged such that removing and/or inserting of the barrier connection apparatus with the barrier elements is in a direction transverse or perpendicular to a longitudinal axis of the barrier elements.

* * * * *